United States Patent [19]

Tacchi

[11] Patent Number: 4,463,899

[45] Date of Patent: Aug. 7, 1984

[54] RELATING TO SHOWER FITTINGS

[76] Inventor: Percy G. Tacchi, Middle Scriven, Bridgnorth, Salop WV 16 6AG, England

[21] Appl. No.: 334,422

[22] Filed: Dec. 24, 1981

[51] Int. Cl.[3] ..... B05B 7/00

[52] U.S. Cl. ..... 239/75; 239/414; 239/588; 236/12.23

[58] Field of Search ..... 239/569, 378, 414, 415, 239/75, 587, 588; 236/12.16, 12.23, 93 A

[56] References Cited

U.S. PATENT DOCUMENTS

| | | | |
|---|---|---|---|
| 282,069 | 7/1883 | Frost | 236/12.23 |
| 1,780,589 | 11/1930 | Hendrix | 236/12.23 |
| 2,465,458 | 3/1949 | Jordan | 236/12.23 |
| 2,717,806 | 9/1955 | Dale | 239/415 |
| 2,965,313 | 12/1960 | Jay | 239/569 |
| 3,581,998 | 7/1970 | Roche | 239/525 X |
| 4,299,354 | 11/1981 | Ketley | 236/93 A |
| 4,394,969 | 7/1983 | Jette | 239/414 |

FOREIGN PATENT DOCUMENTS

| | | |
|---|---|---|
| 1345745 | 2/1974 | United Kingdom . |
| 1403874 | 8/1975 | United Kingdom . |
| 1479211 | 7/1977 | United Kingdom . |

*Primary Examiner*—John J. Love

*Attorney, Agent, or Firm*—Marshall, O'Toole, Gerstein, Murray & Bicknell

[57] ABSTRACT

A shower fitting for a domestic installation comprises a shower head, which can be held in the hand, and which comprises inlet connections adapted to be connected by flexible conduit to supplies of hot and cold water. The shower head comprises a body, the interior of which is formed to provide a mixing chamber to which hot and cold water is delivered, and from which water flows to a spray outlet of the shower head. The temperature of the water flowing from the shower head is controlled by a thermostatic control member on the body, which includes means for positively shutting off the flow of water from the shower head.

4 Claims, 14 Drawing Figures

10
31
30
25
19
23
37
38
32
33
34
35
13
14
26
28
27
29
C
H

RELATING TO SHOWER FITTINGS

BACKGROUND OF THE INVENTION

1. Field of the Invention

This invention is concerned with a shower fitting of the type which is adapted to be connected to supplies of hot and cold water and which is adapted to provide a supply of water, the temperature of which may be varied by varying the proportions in which the hot and cold water are mixed together, such fittings comprising a shower head comprising an inlet connection for the inlet of water and a spray outlet from which water flows in the form of a spray, and particularly of the kind in which the shower head is capable of being held in the hand by the user and moved freely about as is desired. Such a shower fitting is hereinafter referred to as being of the kind specified.

2. Description of the Prior Art

A shower fitting of the kind specified may comprise a generally Y-shaped conduit, two branches of which comprise end portions which are adapted to be secured to hot and cold water taps, and the third branch comprising an end portion which is secured to the shower head, which may be used remote from the taps, the hot and cold water mixing together in the third branch of the conduit as it flows towards and into the shower head.

One of the difficulties encountered in shower fittings of this kind is that there is often difficulty in exercising control over the temperature of the water flowing through the outlet by virtue of the distance which there may be between the taps and the user, and by virtue of the time delay in response to such exercise of control by the quantity of water in the conduit.

Another of the difficulties which is encountered is when it is desired to shut off the water flowing from the shower head, and this must be effected by turning off the taps, which may be remote from the user.

Another shower fitting of the kind specified comprises a fixed mixing unit, which may be secured to a wall of a shower cubicle, to which supplies of hot and cold water are delivered, and a single flexible conduit extending from the mixing unit to the inlet connection of the shower head, the mixing unit comprising valve means which may be operated manually to vary the proportions in which the hot and cold water are mixed to flow along the conduit towards the shower head. The valve means may comprise a single operating member, which may be thermostatically controlled, or may comprise separate taps for controlling the rate of flow of hot and cold water to the mixing unit. Such types of shower fitting may comprise a fixed mounting bracket secured to the wall of the shower cubicle on which the shower head may be releasably mounted so that the shower head can be used alternatively in this position or in a position removed from the mounting bracket.

Shower fittings of this kind suffer not only from the difficulties set out above, but also from the difficulty that the mixing unit projects out into the area of the shower cublicle where it can prove an awkward obstacle for the user of the shower. Attempts to overcome this problem have involved the provision of a suitable recess in the wall of the shower cubicle, so that the whole of the mixing unit and the valve means can be accommodated in such recess but this considerably increases the overall costs of the shower installation.

It has also been proposed to position the mixing unit and the valve means outside the shower cubicle, such as on the remote side of a shower curtain, but this makes the control difficult for the user to reach.

Further, where the hot water is mixed with cold water from a public mains supply, and where it is required that there be positive means for isolating one supply from the other when the shower is not in use, this requires the provision of a positive shut-off valve means in the mixing valve itself. This latter expedient is difficult to accomplish in practice, because when the shower head is in its static position, mounted on the mounting bracket, there may be a static head in the order of about four feet of water remaining in the conduit between the valve and the shower head, and this head of water can cause leakage past the shut-off valve.

A further type of shower fitting is known as the instantaneous type, and comprises a heating chamber an inlet of which is connected to a cold water mains supply, and an outlet of which is connected to a shower head. The heating element in the heating chamber may be designed to operate under constant heat input, the temperature of the water flowing from the shower head being controlled by a valve means which controls the rate of flow of water through the heating chamber between a lower rate, corresponding to a safe maximum temperature, and a higher rate. The heating chamber would additionally comprise a safety device operative to switch off the heating element in the event of an unsafe high temperature being reached by the water flowing therethrough.

However such shower fittings suffer from the disadvantage that the flow rate may vary with variation in water pressure, such as may be caused by another person in the premises turning on a mains water tap, and such variations in flow rate will produce changes in the temperature of the water flowing from the shower head, which may be uncomfortable and/or inconvenient.

It is one of the various objects of the invention to provide an improved form of shower fitting which reduces the difficulties set out above.

SUMMARY OF THE INVENTION

According to this invention there is provided, in or for a shower fitting of the type which is adapted to be connected to supplies of hot and cold water and which is adapted to provide a supply of water, the temperature of which may be varied by varying the proportions in which the hot and cold water are mixed together, the fitting comprising a shower head comprising inlet connection means for the inlet of water and a spray outlet through which water flows from the shower head, the improvement wherein the shower head comprises a body which is formed internally to provide a mixing chamber, inlet connection means being provided on the body to which separate supplies of hot and cold water may be connected, such supplies of water flowing into the chamber wherein said supplies are mixed, the proportions in which the hot and cold water flow into the mixing chamber, and hence the temperature of the water flowing from the outlet, being controlled by valve means mounted on the body of the shower head.

Said valve means may be wholly manually operated or it may be thermostatically controlled and preferably includes a temperature responsive device which is under the influence of the temperature of the water mixture and which operates a movable valve member to control the proportions of hot and cold water entering the mixing chamber.

Preferably the body is of elongate form, the movable valve member being arranged for sliding movement (e.g. linear or rotary) in the body and may conveniently be in the form of a flat plate or ported disc provided with control ports and having sliding engagement with a flat face or faces of a valve block which has supply ports therein connected to the inlets for the hot water and cold water.

With a shower head according to the present invention, when in the static position, there is very little head of water in the mixing chamber (possibly 2 inches or less) and thus more favourable conditions for a positive shut-off valve to function satisfactorily.

Thus preferably the valve means is also operative to Provide for complete shut-off of water flowing into the mixing chamber.

DESCRIPTION OF THE PREFERRED EMBODIMENT

Figure 1:
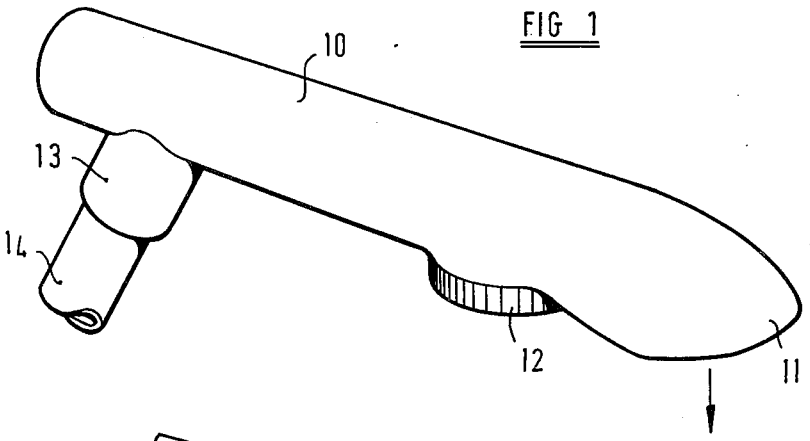
FIG. 1 is a perspective view showing the exterior shape of one form of a shower head which is a preferred embodiment of this invention and which has been selected for the purposes of illustrating the invention by way of example.

Referring to FIG. 1, the body 10 of the shower head is of generally elongated form and of such external dimensions as to enable the user to easily hold it in the hand and in the form shown in FIG. 1, the actual spray head is indicated at 11 at the one end of the body with the direction of the outcoming spray indicated by the arrow. A manual control knob 12 is positioned adjacent the spray head 11 and the inlet manifold 13 is positioned adjacent the opposite end of the body with a common inlet conduit 14 by which separate supplies of hot and cold water may be connected to the manifold 13.

Figure 2:
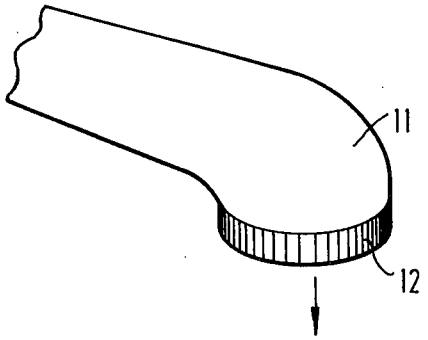
FIGS. 2 and 3 are fragmentary views showing alternative positions for the actual spray head.
Figure 3:
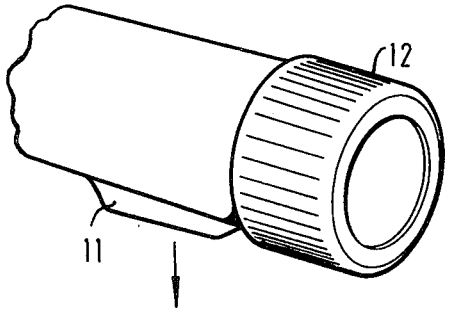

In the alternative arrangement of FIG. 2, the manual control knob 12 is combined with the spray head 11 at the one end of the body and in another possible arrangement shown in FIG. 3, the spray head 11 is arranged adjacent the end of the body with the manual control knob 12 positioned at the extreme end of the body.

Figures 4, 4A, 4B, 4C:
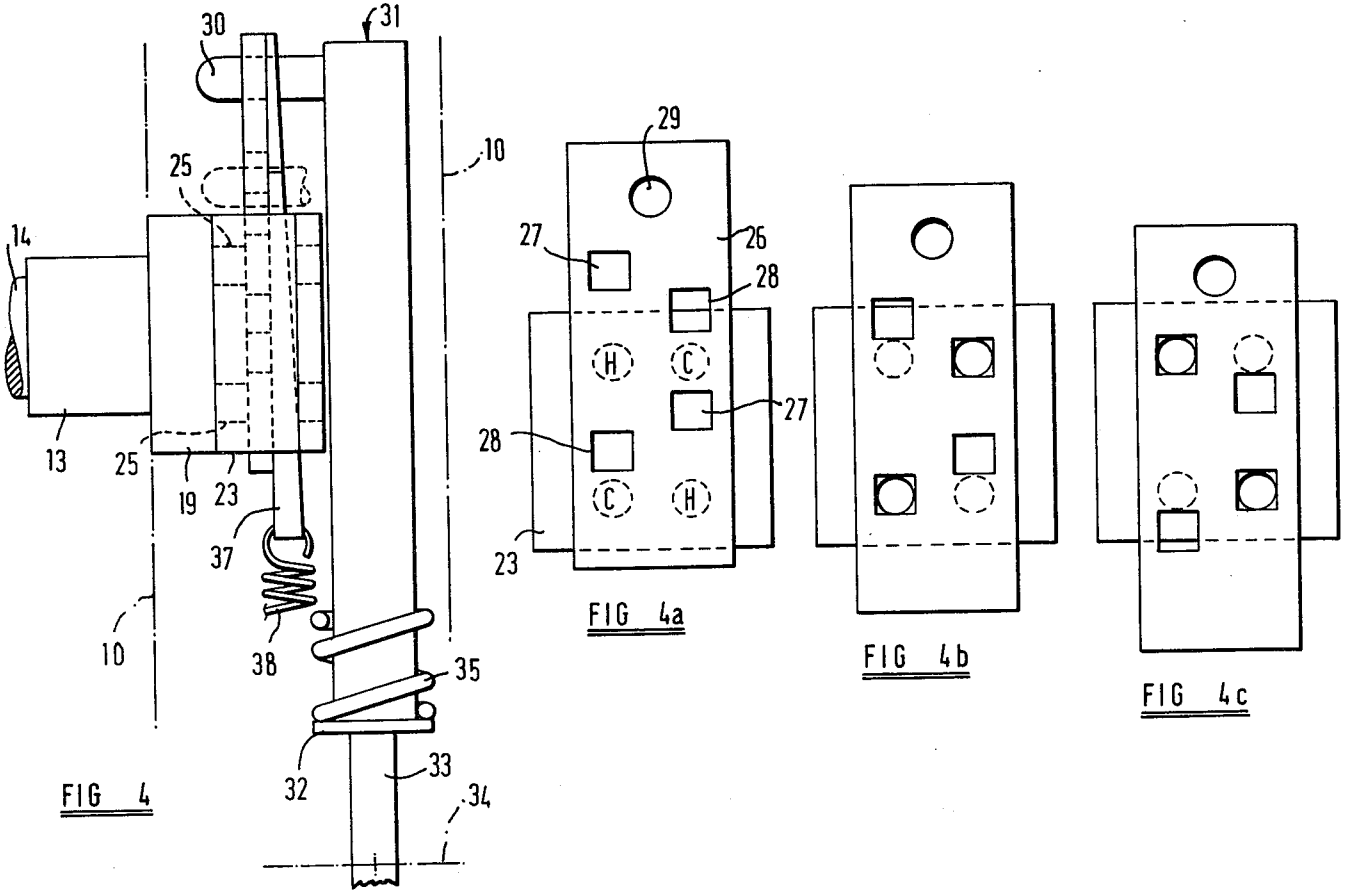
FIG. 4 is a view in side elevation showing the interior mechanism including thermostatic control and positive shut-off means.
FIGS. 4*a*, 4*b* and 4*c* are diagrammatic views showing different positions of the valve control plate.
Figure 5:
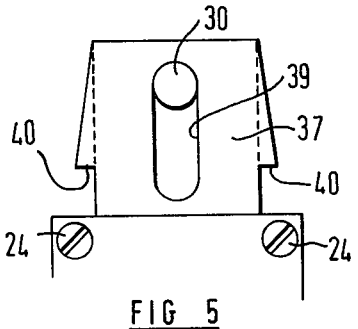
FIG. 5 is a detail view to illustrate the position where the wedge plate is in the fully shut-off position.
Figure 6:
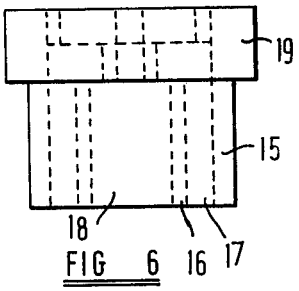
FIG. 6 is a detail view of the inlet manifold.
Figure 7:
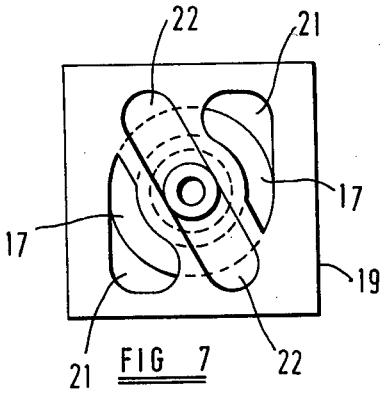
FIG. 7 is a top plan view on FIG. 6.
Figure 8:
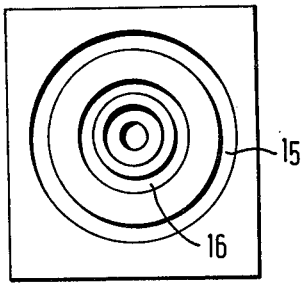
FIG. 8 is a bottom plan view on FIG. 6.

Referring now to FIGS. 4 to 9, the outline of the body 10 is indicated by the chain dotted lines in FIG. 4, which view is arranged so that the shower head is shown in an upright and inverted position, the inlet manifold 13 being at the top and the manual control knob 12 and spray head 11 (not shown in FIG. 4) being at the bottom. The inlet manifold 13 comprises two concentric tubes, there being an outer tube 15 and an inner tube 16, with an annular space 17 between these two tubes (FIG. 8). The flexible conduit 14 which conveys the hot and cold water from the supplies to the shower head is also of concentric construction, having an outer tube and an inner tube with an annular space therebetween so that one fluid can flow along the annular space and the other fluid along the inner tube. In the example shown, the cold water supply is connected to the outer tube so that cold water flows through the annular space and eventually through the annular space 17 of the manifold and hot water flows through the inner tube and eventually through the central tubular portion 18 of the manifold (FIG. 6).

However, if desired separate connection means for the hot and cold water supplies may be provided on the body, to which separate conduits are connected.

Figure 9:
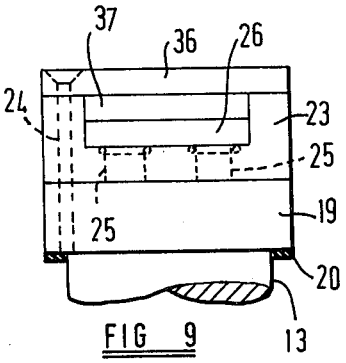
FIG. 9 is a detail plan view of the valve block, looking from above in FIG. 4.

The manifold 13 may be formed integrally with the body 10 (e.g. as a moulding in plastics material) or it may be a separate part which is fitted to the body. Within the body the manifold has a part 19 of square form and in the case where the manifold is formed separately from the body, a suitable sealing gasket 20, as shown in FIG. 9, would be provided between the part 19 and the opening in the wall of the body 10. As shown in FIG. 7, the part 19 of the manifold is formed with two cold water passages 21 extending therethrough and communicating with the cold water space 17 and a common hot water passage 22 communicating via a central passage in the part 19 with the central hot water inlet 18.

The mixing valve body 23 is secured to the part 19 of the inlet manifold by the use of a number of screws, one of which is shown at 24 in FIG. 9, and the valve body 23 has four separate ports extending therethrough, two of which communicate with the cold water passages 21 in the part 19 of the manifold and the other two of which communicate with the common hot water passage 22 in the part 19. Such ports are indicated at 25 in FIG. 4 and FIG. 9, and in the diagrammatic view of FIGS. 4*a* to 4*c*, the ports are designated by the letter C which indicate cold water ports and H to indicate hot water ports.

A valve control plate 26, which is of flat form, is mounted within the valve body 23 in sliding engagement with the flat face of the valve block to which the ports 25 extend, and as shown in FIGS. 4*a* to 4*c*, the valve control plate 26 is provided with four apertures each of square form and arranged in two pairs, there being two apertures 27 for co-operation with the hot water ports 25 in the valve block and two apertures 28 for co-operation with the cold water ports 25 in the valve block.

Near its one end, the valve control plate 26 has an aperture 29 through which projects a peg 30 connected to the one end of the body of a temperature responsive thermostat device generally indicated at 31, and at its opposite end the body of the thermostat 31 has an abutment plate 32 which bears against the periphery of a cam comprising a circular disc 33 mounted eccentrically about an axis of rotation 34, with the manual control knob 12 being connected to the cam 33 and also rotatable about the axis 34. The body of the thermostat 31 is urged resiliently into contact with the periphery of the cam 33 by means of a coil spring 35 engaging the abutment plate 32 at one end and engaging a fixed abutment (not shown) within the body 10 at its other end. The temperature responsive thermostat device 31 may be of generally known form such as a wax-filled capsule or bellows, or known form of linear bimetallic device having the characteristic that increase in temperature results in corresponding increase in the effective overall length of the device 31, there being a corresponding contraction in overal effective length upon decrease in temperature. Such temperature responsive devices are well known and further description is not considered necessary.

The valve block 23 is completed by a cover plate 36 (FIG. 9) secured to the projecting sides of the valve block by the screws 24 so as to leave a space between the inside face of the cover plate 36 and the valve control plate 26, such space being of rectangular cross-sectional area and having fitted therein a wedge plate 37 (FIG. 4) which has one flat face in sliding engagement with the one face of the valve control plate 26 and has its tapered face in engagement with a correspondingly tapered face formed on the inside of the cover plate 36. At its larger cross-section end, the wedge plate 37 has connected thereto a coil spring 38 which at its other end is connected to a fixed member within the body 10 so that the wedge plate 37 is urged resiliently in the direction towards the axis 34 of cam 33, which is the downwards direction as seen in FIG. 4.

At its end remote from the spring 38, the wedge plate 37 has an elongated slot 39 (FIG. 5) extending in the direction of its length and engaging over the projecting peg 30.

From the above it will be appreciated that the hot water and cold water entering via the manifold 33 passes through the passages 21 and 22 in the manifold and then through the separate hot water and cold water ports 25 in the valve block 23 and then into the interior of the body 10 when the valve control plate 26 is in a partially open or fully open position where the hot water mixes with the cold water to provide a warm or hot water mixture which exits through the spray head 11. In the position of the part shown in FIG. 4, the valve control plate 26 is in the position of FIG. 4*a* so that the valve is in the fully shut-off position.

To operate the mixing valve of the shower head from this fully shut-off position, the manual control knob 12 is turned so as to rotate the cam 33 and allow the spring 35 to urge the thermostat device 31 in the downwards direction as seen in FIG. 4, so as to move the valve control plate 26 from the fully shut-off position of FIG. 4*a* to a first intermediate position as shown in FIG. 4*b* in which the two ports 28 in the valve control plate are in full register with the two cold water ports in the valve block, with the hot water ports 27 of the control plate being out of register with their corresponding hot water ports in the valve block so that a supply of cold water is obtained from the spray head. Further movement of the manual control knob in the same direction will bring the valve control plate 26 to the fully open position shown in FIG. 4*c* where only the hot water ports 27 are in register with their corresponding ports in the valve block, the cold water ports being out of register so that a supply of hot water at maximum temperature is available.

In use, a position somewhat between FIG. 4*b* and 4*c* can be selected to provide a discharge of warm water at a desired temperature and having reached such selected position, the position of the valve plate 26 in relation to the valve block 23 is maintained by the thermostat device 31 which moves in the appropriate direction to alter the position of the valve control plate 26 in response to any increase or decrease in temperature of the water mixture.

It will be appreciated that once the manual control is operated to move the valve plate 26 from the fully closed position of FIG. 4*a*, the pressure exerted by the wedge plate 37 is reduced and there is only a minimum amount of frictional resistance to movement of the plate 26 over the range from fully closed to fully open. Such frictional resistance to movement can be further reduced by the choice of suitable materials for the valve block 23, valve control plate 26 and wedge plate 37.

As seen in FIG. 5, the wedge plate 37 has projecting shoulders 40 which are for the purpose of limiting the travel of the wedge plate 37 from the fully shut-off position (FIGS. 4 and 4*a*). During the opening operation of the valve when the wedge plate reaches the position corresponding to FIG. 4*b*, the shoulders 14 engage the valve block 23 to prevent a further movement of the wedge plate and then in between the position of FIGS. 4*b* and 4*c* the peg 30 can move freely in the slot 39 of the wedge plate until the manual control knob is again operated to shut off the valve when the peg 30 engages the end of the slot 39 and positively moves the valve plate 26 and wedge plate 37 towards the shut-off position, and also ensures the positive wedging action of the wedge plate 37 to firmly press the valve control plate 26 into sealing engagement with the cooperating face of the valve block 23.

The requirement for a positive shut-off and isolation of the hot and cold water supplies is thus satisfied and, as explained hereinbefore, as there is only a minute head of static water likely to remain in the body 10 when it is in its static position there is unlikely to be any leakage through the valve of such remaining water. Such possibility can be further reduced by providing a pin hole at the underside of the body 10 as shown in FIG. 1 to allow any such remaining water to drain away. During operation such pin hole would be covered by the hand of the user and no water would escape therefrom. An alternative arrangement would be to have a valve (e.g. a ball valve) opening in the position where a head of water could exist, i.e. gravity operated.

The spring 38 acting on the wedge plate 37 ensures that when the mixing valve is operating the wedge plate will be moved to the position corresponding to FIG. 4*b* where it is arrested by engagement of the shoulders 40 and is thus always, during operation, in the position which offers minimum of frictional resistance to movement of the valve control plate 26.

Figure 10A:
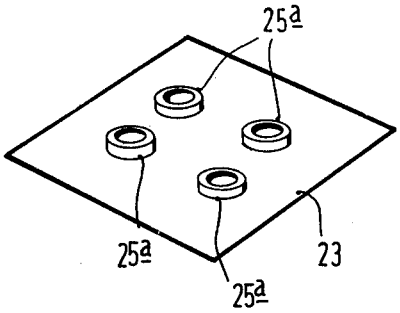
FIGURE 10*a* is a fragmentary perspective view of the face of the valve body.
Figure 10:
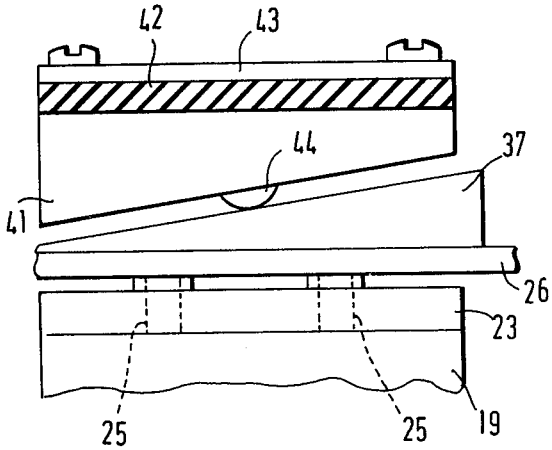
FIG. 10 is a fragmentary view showing additional details of the valve construction.

Referring now to FIG. 10, there is shown there a preferred practical feature of the construction of the valve in the form of a pad 42 of resilient material interposed between the heads of the securing screws and the plate 41 having the inclined surface which is opposite the wedge plate 37. An outer cover plate 43 is provided beneath the heads of the screws and the presence of the resilient pad 42 ensures that when the valve is assembled a known force is exerted through the wedge plate 37 upon the valve control plate 26. This arrangement also provides compensation for wear without changing the linear relationship of the sliding parts.

In practice it may be found difficult to ensure that there is a perfectly flat surface on the ported face of the valve block 23 which is engaged by the control plate 26 and to overcome this problem the construction shown in FIGS. 10 and lO*a* may be used wherein the port openings are constituted by locally raised collars 25*a*, the outer faces of which can be formed accurately in a common plane and thus the flatness of the remaining area of this face of the valve block is not critical. Instead of collars raised from the face of the valve block, "0" rings could be used, inserted in said face.

In order to ensure that the pressure exerted on the collars 25*a* by the control plate 26 is evenly distributed over all four, the inclined face of the top plate 41 may have a part-spherical projection 44 which engages the wedge plate 37, the projection 44 being positioned so that its point of engagement with the wedge plate 37 is centrally located equidistant from the axial centre lines of all four collars 25*a*.

In an alternative arrangement the control of operation of the wedge plate may be separated from that of the control plate 26 by providing a second cam, on the same shaft as the cam 33, to control the wedge plate; this will allow for designing independent cam dwells as required.

The shower head above described may be used in a shower fitting of the type comprising flexible conduit, which may be co-axial (as described above), or may comprise twin hose connected at one end to the inlet manifold, and at the other end to separate hot and cold water outlets. Such outlets may be provided by fixed conduits provided (e.g.) in a shower cubicle there being also provided a mounting bracket on which the shower head may be mounted when desired, or may be provided by hot and cold water taps. Alternatively, such a shower fitting may be utilised in conjunction with a supplementary outlet of the type often provided on baths, a manual control member of which being movable alternately between a first position in which water is directed through an outlet into the bath itself, and a second position in which the water is directed through the supplementary outlet.

In the application of the invention to a shower fitting of the instantaneous type, it is envisaged that the flexible conduit will be connected at one end to the inlet manifold, and at the other end to the outlet of the heating chamber on the one hand, and to an additional cold water supply on the other hand. Such additional cold water supply may conveniently be provided by a bypass duct, conveniently being taken off adjacent to the inlet of the heating chamber. The valve means of the shower head may thus operate to monitor the temperature of the water flowing from the spray outlet thereof and in the event of a sudden rise in the temperature of the hot waterflowing from the heating chamber to the shower head, the valve means will be operative to increase the rate at which cold water is admitted to the mixing chamber, and/or to decrease the rate at which hot water is admitted to the mixing chamber, to stabilise the temperature of the water flowing from the shower head to the desired temperature.

I claim:

1. In or for a shower fitting of the type which is adapted to be connected to supplies of hot and cold water and which is adapted to provide a supply of water, the temperature of which may be varied by varying the proportions in which the hot and cold water are mixed together, the fitting comprising a shower head comprising inlet connection means for the inlet of water and an outlet from which water flows from the shower head, the improvement wherein the shower head comprises an elongate body which is formed internally to provide a mixing chamber, an inlet connection manifold being provided on the body to which separate hot and cold water supply conduits may be connected, the hot and cold water flowing into the chamber wherein it is mixed, the proportions in which the hot and cold water flow into the mixing chamber, and hence the temperature at which the water flows from the outlet, being controlled by thermostatically controlled valve means mounted on the body of the shower head, said valve means including a linearly expandable and contractable temperature responsive device which is under the influence of the temperature of the water mixture and which operates a movable valve member to control the proportions of hot and cold water entering the mixing chamber, and a manually operable control member on the body of the shower head, the movable valve member being slidable in the body and being in the form of a flat plate provided with control ports and having sliding engagement with a flat face or faces of a valve block which has supply ports therein connected to the inlets for the hot water and cold water, one end of the flat plate being connected to one end of the temperature responsive device, the other end of the device being in engagement with means connected to said manually operable control member on the body of the shower head, there being provided a wedge plate engaging said flat plate on the side thereof remote from the valve block, the wedge plate being slidable in relation to the valve block so as to apply pressure, by means of a wedging action, to said flat plate to press the plate against the said flat face or faces of the valve block.

2. A shower head according to claim 1 wherein the supplies of hot water and cold water are through conduits connected to a manifold which has passages therein to convey the hot and cold water separately to the valve block.

3. A shower head according to claim 1 wherein the said other end of the temperature responsive device is urged resiliently into engagement with a rotatable cam which is connected to the control member.

4. A shower head according to claim 1 wherein the valve means is also operative to provide for complete shut-off of water flowing into the mixture chamber.

* * * * *